US007228630B2

(12) United States Patent
Obermann

(10) Patent No.: US 7,228,630 B2
(45) Date of Patent: Jun. 12, 2007

(54) HAIR-CUTTING APPARATUS COMPRISING A HAIR SUCTION DEVICE

(75) Inventor: Wolfgang Johannes Obermann, St. Jakob (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/518,263

(22) PCT Filed: Jun. 18, 2003

(86) PCT No.: PCT/IB03/02768

§ 371 (c)(1),
(2), (4) Date: Dec. 16, 2004

(87) PCT Pub. No.: WO2004/002690

PCT Pub. Date: Jan. 8, 2004

(65) Prior Publication Data

US 2005/0204564 A1 Sep. 22, 2005

(30) Foreign Application Priority Data

Jun. 26, 2002 (EP) ..... 02100749

(51) Int. Cl.
*B26B 19/20* (2006.01)
*B25F 3/00* (2006.01)

(52) U.S. Cl. ..... 30/133; 30/41.5; 30/41.6; 30/124; 30/131; 30/132; 30/135

(58) Field of Classification Search ..... 30/130–135, 30/201, 41.5, 192, 195, 41.6, 124, 30, 31, 30/207, 208, 216, 199, 225, 227, 233.5, 200, 30/202–206, 527; 132/213, 225; D28/58, D28/52–54; D32/5, 30–33; 15/344, 300.1, 15/330, 357

See application file for complete search history.

(56) References Cited

U.S. PATENT DOCUMENTS 1,506,139 A * 8/1924 Severson ..... 30/133

(Continued)

FOREIGN PATENT DOCUMENTS

EP 0325326 A1 7/1989

(Continued)

*Primary Examiner*—Boyer D. Ashley
*Assistant Examiner*—Ghassen Alie
(74) *Attorney, Agent, or Firm*—Adam L. Stroud

(57) ABSTRACT

A hair cutting device with a suction device for drawing off cut pieces of hair is provided. A varier, which may have an adjustable spring loaded movable wall portion, reacts to the circumstances of the hair being cut and adjusts an air flow rate in the area of the suction opening.

4 Claims, 2 Drawing Sheets

U.S. PATENT DOCUMENTS

| | | | | | |
|---|---|---|---|---|---|
| 2,297,735 | A | * | 10/1942 | Allen | 30/133 |
| 2,323,046 | A | * | 6/1943 | Jenkins | 30/133 |
| 2,496,613 | A | * | 2/1950 | Woodward | 83/477.1 |
| 2,697,876 | A | * | 12/1954 | Blanchard | 30/133 |
| 2,748,472 | A | * | 6/1956 | Sheley et al. | 30/133 |
| 2,807,086 | A | * | 9/1957 | Watkins | 30/133 |
| 2,914,849 | A | * | 12/1959 | Watkins | 30/133 |
| 2,929,140 | A | * | 3/1960 | Wilson | 30/133 |
| 2,946,122 | A | * | 7/1960 | Gaskins | 30/133 |
| 2,946,123 | A | * | 7/1960 | Bray | 30/219 |
| 3,073,026 | A | * | 1/1963 | Schaedler | 30/133 |
| 3,302,286 | A | * | 2/1967 | Zucker | 30/133 |
| 3,331,130 | A | | 7/1967 | Ligon | |
| 3,440,681 | A | * | 4/1969 | Wahl et al. | 15/339 |
| 3,447,577 | A | * | 6/1969 | Burrows et al. | 30/377 |
| 4,030,196 | A | * | 6/1977 | Koiwa et al. | 30/133 |
| 4,843,717 | A | | 7/1989 | Crane | |
| 5,153,994 | A | * | 10/1992 | Emmett | 30/133 |
| D337,176 | S | * | 7/1993 | Romani | D28/54 |
| 5,924,202 | A | * | 7/1999 | Romani | 30/133 |
| 6,415,699 | B1 | * | 7/2002 | Bettacchini et al. | 83/397 |
| 2003/0101591 | A1 | * | 6/2003 | Romani et al. | 30/133 |

FOREIGN PATENT DOCUMENTS

| | | | |
|---|---|---|---|
| EP | 0325326 | B1 | 4/1991 |
| JP | 2001190871 | A | 7/2001 |
| JP | 2002159766 | A | 6/2002 |

* cited by examiner

HAIR-CUTTING APPARATUS COMPRISING A HAIR SUCTION DEVICE

The invention relates to a hair-cutting apparatus with a cutting device for cutting hair, and with a suction device for drawing off cut pieces of hair, said suction device being equipped with a suction channel, which is bounded by channel walls, at least some of which extend into the vicinity of the cutting device and, with the ends located in the vicinity of the cutting device, bound a suction opening through which air can be drawn into the suction channel in one suction direction at a specific flow rate.

A hair-cutting apparatus in accordance with the generic type cited in the first paragraph above has been put into trade and is therefore known. Patent document JP 2001-190.871 A may be referred to in connection with a hair-cutting apparatus of this kind. In the known embodiments of a hair-cutting apparatus of this kind, a flow rate that can be only nominally firmly specified can be realized with the suction device in the area of the suction opening. As a result, the problem exists that, with different hair properties and different hair densities and different hair lengths, only suction effects that differ in quality can be achieved, which unfortunately results in the fact that sufficiently good, satisfactory suction effects cannot be guaranteed in all hair circumstances. Moreover, the situation arises that an undesirably great proportion of cut pieces of hair flies out of the hair-cutting apparatus and therefore pollutes the environment.

It is an object of the invention to eliminate the above-mentioned problems and to realize an improved hair-cutting apparatus.

To achieve the above-mentioned object, features in accordance with the invention are provided in a hair-cutting apparatus in accordance with the invention, so a hair-cutting apparatus in accordance with the invention can be characterized in the manner specified below, namely:

A hair-cutting apparatus with a cutting device for cutting hair, and with a suction device for drawing off cut pieces of hair, said suction device being equipped with a suction channel, which is bounded by channel walls, at least some of which extend into the vicinity of the cutting device and, with the ends located in the vicinity of the cutting device, bound a suction opening through which air can be drawn into the suction channel in one suction direction at a specific flow rate, wherein the suction device being equipped with varier means for varying the flow rate in the area of the suction opening.

As a result of the provision of the features in accordance with the invention, a good opportunity is created, in a relatively simple, space-saving manner and with only a small additional expenditure, for maintaining, in the area of the suction opening, different flow rates lying within a relatively great speed range, and thus achieving a matching of the achievable suction effect to the particular hair circumstances. It is also hereby achieved that, in comparison with the circumstances pertaining to the known hair-cutting apparatuses, an undesirable flying-off of cut pieces of hair is considerably reduced.

In the case of a hair-cutting apparatus in accordance with the invention, the varier means may be in the form of a means, disposed within the suction channel, for changing the flow rate in the suction channel and thus in the area of the suction opening. It has, however, proved very advantageous if, in a hair-cutting apparatus in accordance with the invention, the features as claimed in claim 2 are additionally provided. This is advantageous in respect of the simplest possible structural design and in respect of the most efficient possible influencing of the flow rate in the area of the suction opening. This is further advantageous for the reason that a simple adjustment of the changing means is enabled as a result.

In a hair-cutting apparatus in accordance with the invention, as cited in the previous paragraph, the adjustment of the section of the channel wall can be made manually, for instance with the aid of a sliding button acting on the section. It has, however, proved especially advantageous if, in addition, the features as claimed in claim 3 are provided. An automatic adjustment of the varier means as a function of the hair to be cut is hereby advantageously enabled.

In a hair-cutting apparatus in accordance with the invention as cited in the previous paragraph, it has proved extremely advantageous if, in addition, the features as claimed in claim 4 are provided. An especially operationally-reliable, space-saving, easily-movable embodiment is achieved as a result.

With reference to the spring energy of the rod-spring, it has proved extremely advantageous if, in a hair-cutting apparatus in accordance with the invention, the features as claimed in claim 5 are additionally provided. With the aid of the rod-spring, an advantageously favorable counterforce can be achieved in this manner to counter the adjustment forces that can be applied to the section of a channel wall with the aid of the hair.

The above-mentioned aspects and further aspects of the invention are explained below.

The invention will be further described with reference to examples of embodiments shown in the drawings, to which, however, the invention is not restricted.

Figure 1:
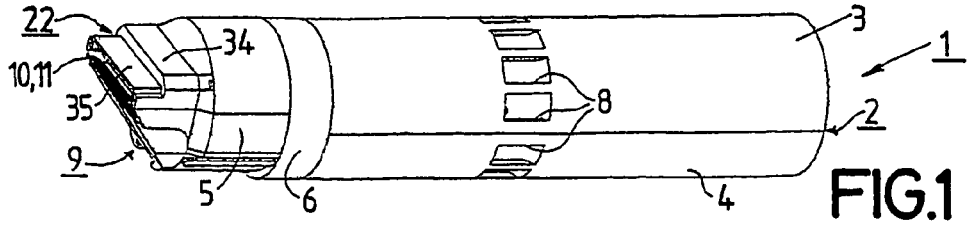
FIG. 1 shows, in an oblique view from above, a hair-cutting apparatus in accordance with one embodiment of the invention.
Figure 2:
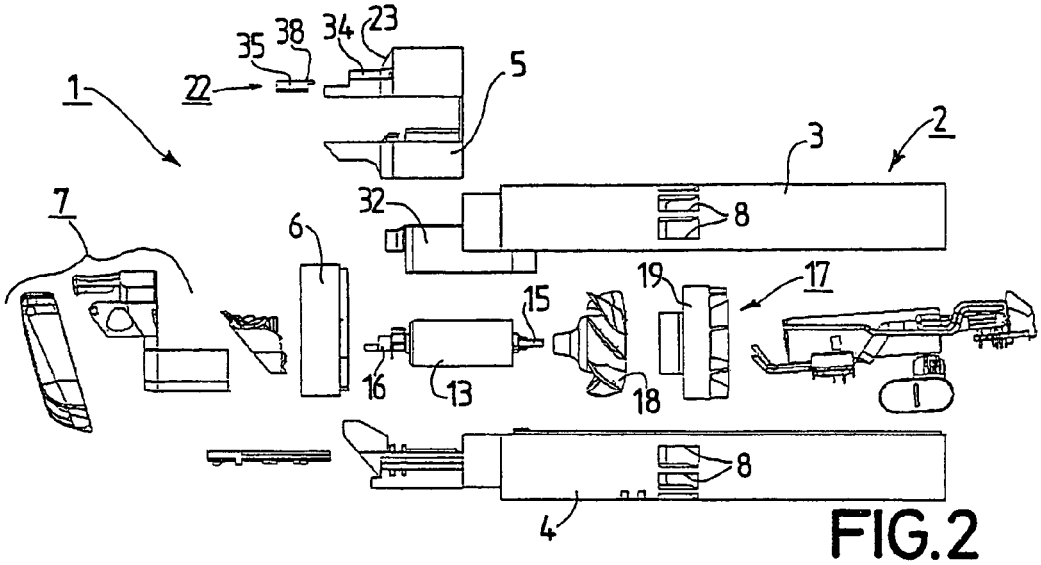
FIG. 2 shows, in an exploded view, the significant components of the hair-cutting apparatus in accordance with FIG. 1.
Figure 3:
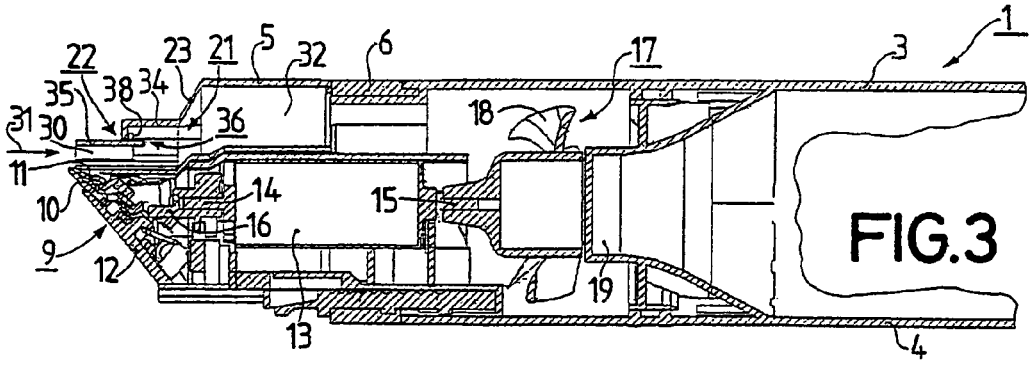
FIG. 3 shows, in cross-section, one part of the hair-cutting apparatus in accordance with FIG. 1.

FIG. 1 shows a hair-cutting apparatus 1. The hair-cutting apparatus 1 is equipped with a housing 2, which comprises an upper housing part 3 and a lower housing part 4 and a forward housing part 5. Between the forward housing part 5 and the two other housing parts 3 and 4 is provided an adjusting ring 6 with the aid of which, by twisting the same, a comb 7 of hair-cutting apparatus 1, which is not shown in FIG. 1 but is shown in FIG. 2, can be adjusted in parallel with the longitudinal direction of hair-cutting apparatus 1, which is known per se. Patent document EP 0 325 326 B1 may be referred to in this connection, the disclosure of which is deemed to be included here by virtue of this reference. In the upper housing part 3 and in the lower housing part 4, through-holes 8 are provided roughly in their central areas, through which air can flow out from the interior of housing 2.

On the side of the forward housing part 5 that faces away from adjusting ring 6, hair-cutting apparatus 1 is equipped with a cutting device 9. Cutting device 9 is provided and designed to cut the hair. Cutting device 9 is equipped with two toothed cutting blades 10 and 11, wherein the first toothed cutting blade 10 is held stationary on a carrier 12 of toothed cutting device 9 and the second toothed cutting blade 11 is carried so as to be movable back and forth in relation to the first toothed cutting blade 10 and can be driven back and forth, which has been known for a long period.

The hair-cutting apparatus 1 comprises a motor 13, which is equipped with a first drive shaft 14 and a second drive shaft 15. Positioned on the first drive shaft 14 so as to be secured against rotation is an eccentric configuration 16. Eccentric configuration 16 is coupled to the second toothed cutting blade 11, so that, with the aid of the eccentric configuration 16, the second toothed cutting blade 11 can be driven back and forth.

Figure 4:
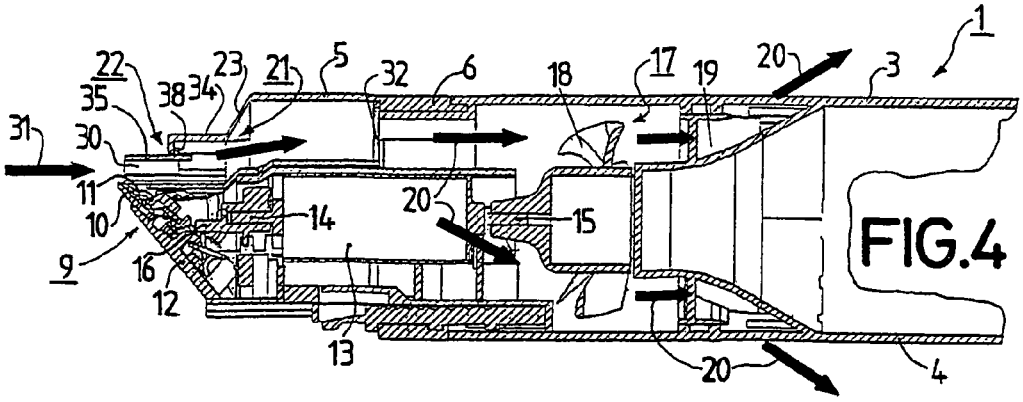
FIG. 4 shows, in a manner analogous to FIG. 3, the part of the hair-cutting apparatus in accordance with FIG. 3, wherein, in addition, an air flow that can be generated in the hair-cutting apparatus is indicated.
Figure 5:
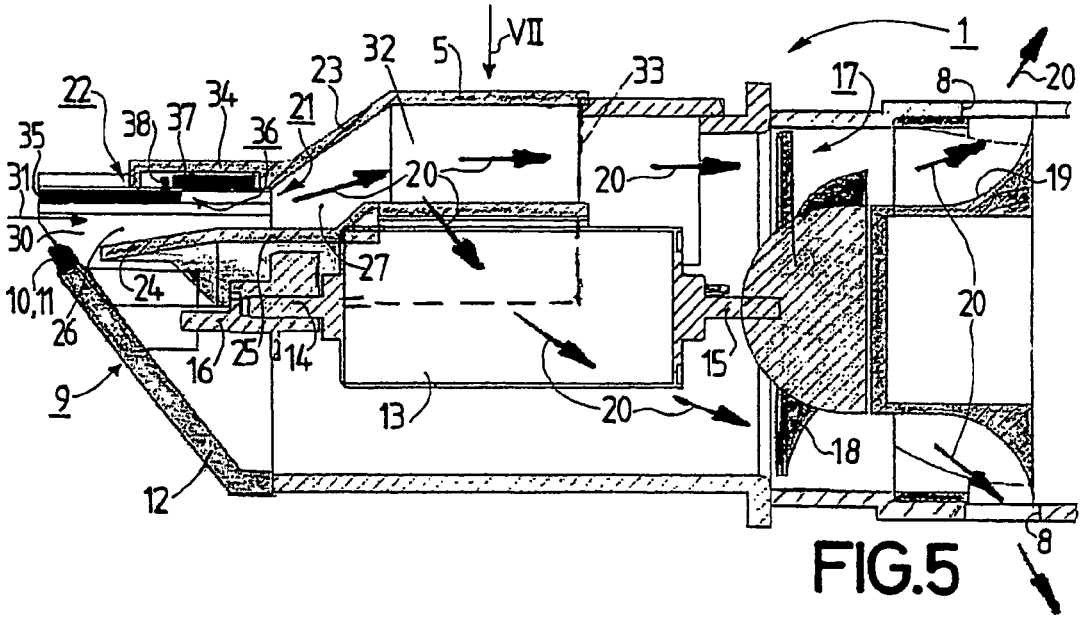
FIG. 5 shows, in a scale enlarged in comparison with FIG. 4 and in a schematized representation, the part of the hair-cutting apparatus in accordance with FIGS. 3 and 4.

Hair-cutting apparatus 1 is further equipped with a suction device 17. Suction device 17 is designed to draw off the cut pieces of hair. Suction device 17 is equipped with a fan 18, which can be driven in rotation and which is positioned on the second drive shaft 15 so as to be secured against rotation and which is additionally supported with the aid of an air-deflection part 19. Fan 18 may, however, also be rotatably supported with only the aid of drive shaft 15, wherein air-deflection part 19 does not then fulfill a dual function. In hair-cutting apparatus 1, an air flow can be generated with the aid of fan 17, which air flow is indicated with arrows 20 in FIGS. 4 and 5. The air flow is deflected, with the aid of air-deflection part 19, towards the through-holes 8. Suction device 17 is equipped with a suction channel 21, which is bounded by channel walls 22, 23, 24, 25, 26, 27, 28 and 29. Of the channel walls, some of the channel walls, namely channel walls 22, 24, 26 and 28, extend as far as the vicinity of cutting device 9 and as far as the vicinity of the two toothed cutting blades 10 and 11 of cutting device 9 respectively. With their ends located in the vicinity of cutting device 9 and in the vicinity of toothed cutting blades 10 and 11 respectively, the four boundary walls 22, 24, 26 and 28 bound a suction opening 30. Through suction opening 30, air can be drawn into suction channel 21 in a suction direction indicated by an arrow 31, at a flow rate that can be changed in an advantageous manner. Located adjacent to suction channel 21 is a collecting container 32, which is provided and designed to collect cut pieces of hair. Collecting container 32 is provided with a filter 33, indicated schematically in FIGS. 5 and 6. With the aid of filter 33, a separation of the cut pieces of hair from the air flow takes place, so that, after collecting container 32, no cut pieces of hair remain in the air flow delivered through through-holes 8.

Figure 6:
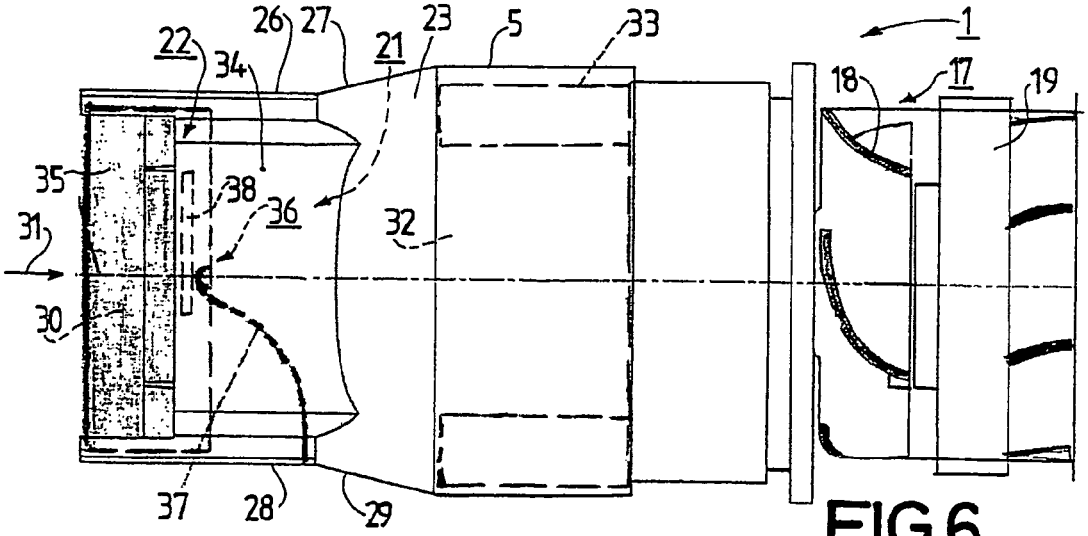
FIG. 6 shows, in a view in accordance with arrow VII in FIG. 5, the part of the hair-cutting apparatus in accordance with FIGS. 3 to 6.
Figure 7:
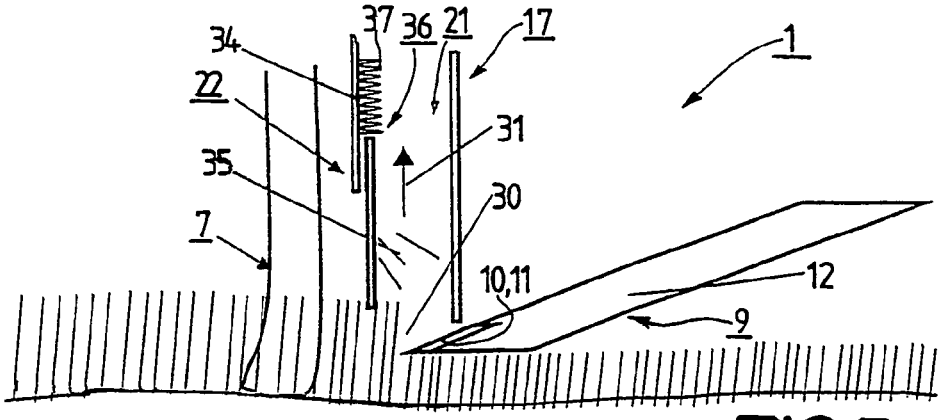
FIG. 7 shows, in a wholly schematized manner, the part of the hair-cutting apparatus in accordance with FIGS. 1 to 6 that is interacting with the hair to be cut.

In hair-cutting apparatus 1, the first channel wall 22, which also forms a boundary wall 22 of hair-cutting apparatus 1, is formed not just by one single stationary wall, but rather, in an especially advantageous manner, the design of the first channel wall 22 is executed in such a way that the first channel wall 22 comprises a stationary section 34 and a section 35, which is adjustable in relation to stationary section 34 and in relation to all channel walls 23 to 29, wherein the adjustment is, in this case, linear and hereby takes place in parallel with suction direction 31. Adjustable channel wall 35 may, however, also be slightly curved and may be carried so as to be adjustable in accordance with the shape of the curve. With its free end, adjustable section 35 bounds suction opening 30. In hair-cutting apparatus 1, adjustable section 35 of channel wall 22 is a component part of varier means 36, which is provided for changing the flow rate of the air flow in the area of suction opening 30. Varier means 36 comprises the adjustable section 35 of channel wall 22, and is further equipped with a spring means 37, which interacts with adjustable section 35 of channel wall 22 and which is shown in FIG. 6. Spring means 37 loads adjustable section 35 of channel wall 22 counter to suction direction 31 and endeavors to hold adjustable section 35 in a starting position. As is shown in a highly schematized manner in FIG. 7, adjustable section 35 of channel wall 22 is designed and disposed to interact with the hair to be cut. During the interaction of adjustable section 35 of channel wall 22 with the hair to be cut, adjustable section 35 is adjustable counter to the force of spring means 37, i.e. in suction direction 31, as indicated in FIG. 7. The extent of the adjustment of adjustable section 35 hereby depends on the circumstances relating to the hair, i.e. on the hair density and the hair length and the hair strength and hair rigidity. As can be seen in FIG. 6, in hair-cutting apparatus 1, spring means 37 is in the form of a rod-shaped spring 37 that extends essentially transversely in relation to suction direction 31, running in a curve, and is secured in the area of the lateral channel wall 28, and the bent free end of which interacts with a strip 38 protruding from section 35. Spring 37 may, however, also be of a leaf-type design. The spring force of spring 37 is nominally around 40 mN. The spring force of spring 37 may lie in a range between 10 mN and 50 mN.

Regarding spring 37, it should also be mentioned that spring 37 is designed as a torsion spring which, in its starting position, i.e. with adjustable section 35 in its starting position, is shaped in accordance with the so-called bending parabola. With the adjustable section 35 maximally adjusted from its starting position, spring 37 assumes a shape that runs in a virtually straight line, which is, however, not shown in FIG. 6.

In hair-cutting apparatus 1, adjustable section 35 of channel wall 22 is further a component of a means which counteracts the flying-off of cut pieces of hair from hair-cutting apparatus 1, which means is equipped with the first channel wall 22, which simultaneously forms a boundary wall 22 of hair-cutting apparatus 1. In addition to channel wall 22 with the adjustable section 35, the means that counteracts the flying-off of cut pieces of hair from hair-cutting apparatus 1 also comprises spring means 37 and the stationary section 34 of channel wall 22 and the further channel walls 24, 26 and 28.

It is achieved with the aid of adjustable section 35 of channel wall 22 that the flow rate of the air flow in the area of suction opening 30 is matched in a simple, automatic manner to the particular hair circumstances, i.e. on the volume of hair introduced, for example, wherein the suction opening 30 is kept as small as possible, depending on the hair circumstances, which results in a maximum flow rate being achieved in each case. This in turn gives rise to a suction result which is matched to the particular hair circumstances and is consequently a good one.

In the starting state, adjustable section 35 of channel wall 22 is kept in the starting position shown in FIGS. 3 to 6 with the aid of spring 37. The spring force of spring 37 is hereby advantageously sufficiently great to compensate for the weight of adjustable section 35 in all circumstances. The force of spring 37 is hereby great enough that adjustable section 34 can be moved back into its starting position in every position of hair-cutting apparatus 1. On the other hand, the spring force of spring 37 is only high enough that, even in the case of relatively little hair interacting with adjustable section 35, adjustable section 35 can be adjusted counter to the force of spring 37 by this small amount of hair. As is shown in FIG. 7, adjustable section 35 is adjusted in suction direction 31 by the hair to be cut, as a result of which an optimum matching of the dimension of suction opening 30 to the hair circumstances prevailing in each case is ensured.

With the aid of the adjustable section 35 of channel wall 22 and of stationary section 34 of channel wall 22 and of channel walls 24, 26 and 28, it is further achieved in the case of hair-cutting apparatus 1 that the flying-off of cut pieces of hair from hair-cutting apparatus 1 is counteracted in an especially good and effective manner. This has the result that virtually all cut pieces of hair enter suction channel 21 and are drawn off with the aid of suction device 17, as indicated schematically in FIG. 7.

The invention claimed is:

1. A hair-cutting apparatus comprising:

a cutting device for cutting hair; and a suction device for drawing off cut pieces of hair, said suction device comprising a suction channel, which is bounded by a plurality of channel walls, wherein at least or more of said channel walls extend into the vicinity of said cutting device and, wherein at least one of said channel walls ends in the vicinity of said cutting device, and surrounds a suction opening through which air can be drawn into said suction channel in one suction direction at a flow rate, wherein said suction device comprises a varier means for varying said flow rate in said vicinity of said cutting device; and wherein said varier means comprises a spring that interacts with an adjustable section of said at least one channel wall wherein said adjustable section moves in a linear direction in response to contact with the hair to be cut and adjusts said flow rate in said vicinity of said cutting device.

2. A hair-cutting apparatus as claimed in claim 1, wherein said spring means spring-loads said adjustable section counter to said suction direction, and wherein said adjustable section interacts with the hair to be cut during the interaction with the hair to be cut, and counters a force of spring means.

3. A hair-cutting apparatus as claimed in claim 2, wherein the spring means is in the form of a rod-type or leaf-type spring that extends essentially transversely to said suction direction.

4. A hair-cutting apparatus as claimed in claim 3, wherein said force of said rod-type or leaf-type spring lies in a range between 10 mN and 50 mN.

* * * * *